US006315258B1

(12) United States Patent
Myler et al.

(10) Patent No.: US 6,315,258 B1
(45) Date of Patent: Nov. 13, 2001

(54) MERCHANDISE DISPLAY BRACKET

(75) Inventors: Jeffry A. Myler, Stow; John M. Vuraich, Willowick, both of OH (US)

(73) Assignee: Darko Company, Inc., Twinsburg, OH (US)

( * ) Notice: Subject to any disclaimer, the term of this patent is extended or adjusted under 35 U.S.C. 154(b) by 0 days.

(21) Appl. No.: 09/416,392

(22) Filed: Oct. 12, 1999

(51) Int. Cl.[7] ..... A47G 29/02; E04G 3/08

(52) U.S. Cl. ..... 248/241; 248/229.15; 248/276.1; 403/84; 403/379.3; 211/95

(58) Field of Search ..... 248/220.21, 682, 248/214, 215, 222.13, 222.52, 225.21, 229.11, 229.21, 291.1, 292.12, 288.11, 229.15, 229.25, 229.16, 229.26, 228.6, 274.1, 295.11, 296.1, 286.1; 211/95, 96, 13.1, 87.01, 94.01, 90.02, 94.02, 97–103, 150, 172, 175

(56) References Cited

U.S. PATENT DOCUMENTS

| | | | | |
|---|---|---|---|---|
| 976,205 | * | 11/1910 | Neuhaus | 211/99 |
| 2,642,250 | * | 6/1953 | Kasnowich | 248/229.1 |
| 2,842,264 | * | 7/1958 | Larson | 206/526 |
| 3,463,433 | * | 8/1969 | Stein et al. | 248/242 |
| 3,472,389 | * | 10/1969 | Lowe | 211/70 |
| 3,490,600 | * | 1/1970 | Reed et al. | 248/220.41 |
| 4,140,296 | * | 2/1979 | Guillen | 248/445 |
| 4,372,425 | * | 2/1983 | Murphy | 182/179 |
| 4,373,639 | * | 2/1983 | Tricon | 211/86 |
| 4,913,297 | * | 4/1990 | Wells | 211/96 |
| 4,934,045 | * | 6/1990 | Breslow | 248/242 |
| 5,330,084 | * | 7/1994 | Peters | 224/42.45 R |
| 5,429,336 | * | 7/1995 | Ko | 248/278.1 |
| 5,553,820 | * | 9/1996 | Karten et al. | 248/286.1 |
| 5,580,018 | * | 12/1996 | Remmers | 248/235 |
| 5,799,917 | * | 9/1998 | Li | 248/284.1 |
| 5,881,983 | * | 3/1999 | Hofmann et al. | 248/274.1 |

* cited by examiner

*Primary Examiner*—Anita King
*Assistant Examiner*—Jon A Szumny
(74) *Attorney, Agent, or Firm*—Renner, Kenner, Greive, Bobak, Taylor & Weber

(57) ABSTRACT

A bracket (10) which is adapted to carry an item of merchandise (12) on a retail display fixture (11) includes a mounting member (16) adapted to be attached to the fixture (11). A support frame (24) is adapted to carry the merchandise (12) and is pivotally attached to the mounting member (16) so that the merchandise (12) may be carried at a selected angle relative to the fixture (11). An adjustment plate (22) carried by the mounting member (16) has apertures (23) therein to receive a protuberance (35) carried by the support frame (24) to maintain the support frame (24) at the selected angle relative to the mounting member (16). The support frame (24) includes laterally spaced, longitudinally extending side members (25) which include posts (26) receivable in hollow arms (27) at selected lateral positions to adjust the lateral space between the side members (25). Selected of a series of apertures (31) in the side members (25) receive a bolt (32) to hold the merchandise (12) on the support frame (24). As a result, the bracket (10) is capable of carrying merchandise (12) of differing lateral and longitudinal sizes.

27 Claims, 4 Drawing Sheets

MERCHANDISE DISPLAY BRACKET

TECHNICAL FIELD

This invention relates to a bracket for carrying merchandise for retail display. More particularly, this invention relates to such a bracket which can suspend a variety of sizes of merchandise from a wall or fixture at a variety of angles relative to the wall or fixture.

BACKGROUND ART

It is often the desire of the retailer to display certain types of merchandise by hanging the merchandise on a wall or fixture. Normally, such merchandise is merely hooked onto the wall or fixture, or in the case of larger items, such as children's toy cars or the like, cables are used to hold the item against the wall. Not only could such support be unsafe, but also such does not permit the carrying of merchandise in a suspended-animation type of configuration, which desirably presents a unique, attractive, and eye-catching manner of displaying merchandise in the retail establishment.

Such a display is not easy to accomplish, and in known displays, the merchandise normally extends perpendicularly outward from or parallel to the wall or fixture. However, the retailer, if space allows, would often want the customer to observe the merchandise from a perspective view, and as such, the merchandise would have to be suspended at some angle to the wall or fixture. To date, there is no known device which can allow the retailer to create such a display whereby the merchandise can be suspended at an angle to the wall or fixture as selected by the retailer.

DISCLOSURE OF THE INVENTION

It is thus an object of the present invention to provide a bracket which can support merchandise on a wall or fixture so that it would appear to be in suspended animation away from the wall.

It is another object of the present invention to provide a bracket, as above, which can be adjusted to carry the merchandise at a wide variety of angles relative to the wall.

It is an additional object of the present invention to provide a bracket, as above, which can be adjusted to carry merchandise of differing sizes.

It is a further object of the present invention to provide a bracket, as above, which can easily be installed on a conventional wall or fixture at the desired location along the wall or fixture.

It is yet another object of the present invention to provide a bracket, as above, in which the merchandise can be readily attached thereto.

These and other objects of the present invention, as well as the advantages thereof over existing prior art forms, which will become apparent from the description to follow, are accomplished by the improvements hereinafter described and claimed.

In general, a bracket for carrying merchandise on a fixture made in accordance with the present invention includes a mounting member adapted to be attached to the fixture. A support frame is pivotally attached to the mounting member and is adapted to carry the merchandise at a selected angle relative to the fixture.

In accordance with another aspect of the present invention, a bracket for carrying merchandise on a fixture includes a mounting member adapted to be attached to the fixture, and a support frame carried by the mounting member and adapted to carry the merchandise. The support frame is adjustable so as to be adapted to carry merchandise of varying sizes.

A preferred exemplary bracket incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
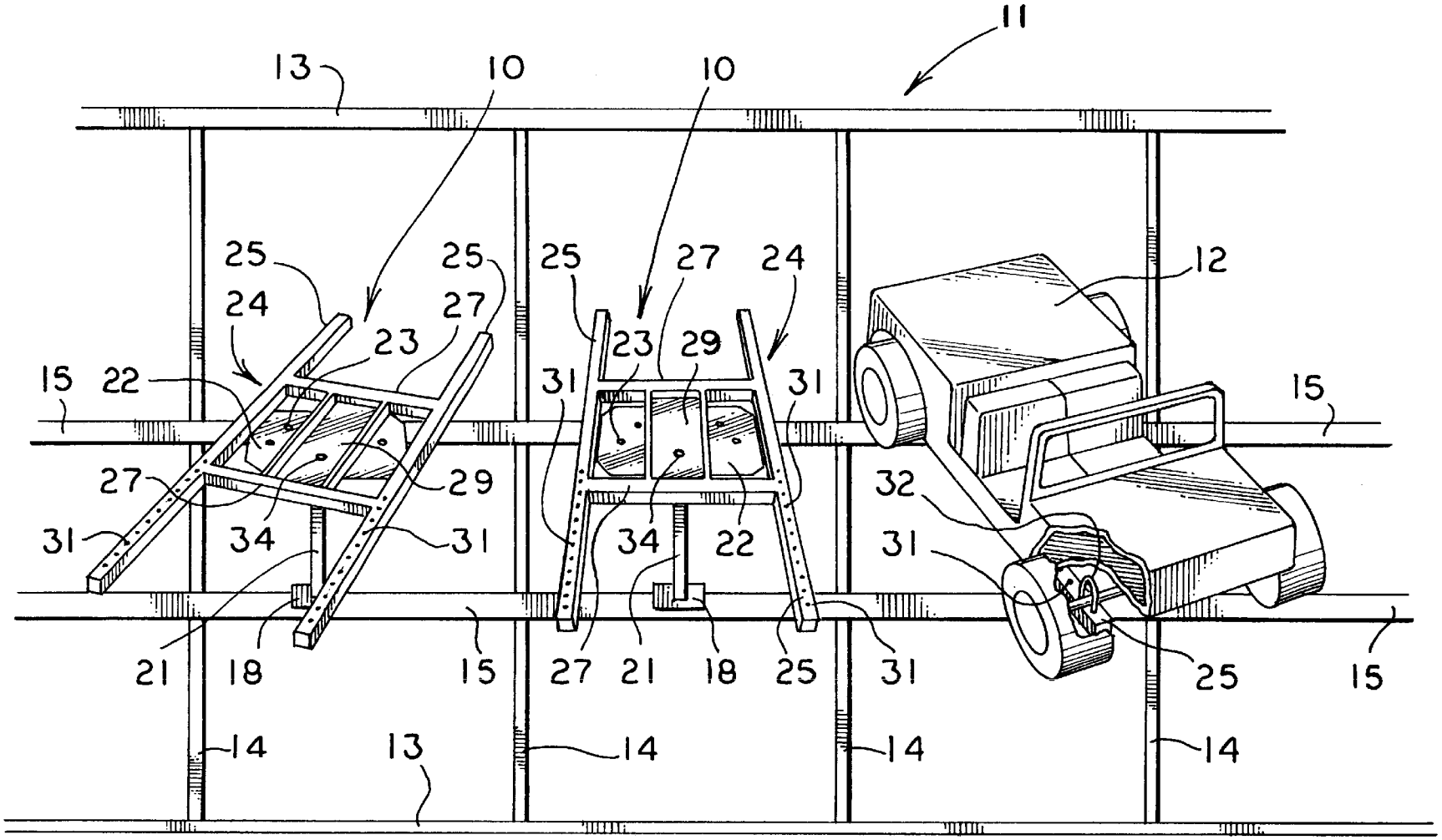
FIG. 1 is a fragmented, schematic view of a merchandising display fixture carrying brackets made in accordance with the present invention, one of the brackets being shown as carrying a child's toy vehicle having a portion thereof broken away.

A bracket made in accordance with the present invention is indicated generally by the numeral 10. As shown in FIG. 1, a plurality of brackets 10 are adapted to be carried by a display wall or fixture generally indicated by the numeral 11. For ease of description, FIG. 1 shows two empty brackets 10 on a portion of fixture 11, and shows one bracket carrying an item of merchandise, such as a child's toy car 12. While an item such as car 12 is particularly suited to be carried by brackets 10, it should be evident that brackets 10 could carry any type of merchandise which the retailer would deem to be particularly suited for the suspended-animation, elevated type of display shown in FIG. 1. It should also be appreciated that brackets 10 are designed so that fixture 11 can carry a plurality of vertically spaced rows of merchandise, with each item of merchandise within a row being laterally spaced from each other.

Fixture 11 can be a stand-alone fixture or can include structural components merely carried by a wall of a retail establishment. The fixture 11, schematically shown in FIG. 1, includes upper and lower horizontally extending supports 13 having a plurality of vertically extending, laterally spaced stanchions 14 positioned therebetween. A plurality of generally horizontal and vertically spaced support bars 15 extend between stanchions 14 and, as will hereinafter be described, vertically adjacent bars 15 are adapted to carry brackets 10.

Each bracket 10 is preferably made of a plurality of metallic components suitably attached, as necessary, as by welding, and includes a somewhat D-shaped mounting member generally indicated by the numeral 16. Mounting member 16 includes a base arm 17 which carries a channel plate 18 on each end thereof. Channel plates 18 are adapted to snap onto or otherwise engage adjacent support bars 15 of fixture 11. When a bracket 10 is properly positioned on fixture 11, base arm 17 will thus be vertically oriented and will extend between adjacent support bars 15.

Mounting member 16 also includes an upper arm 19 extending generally laterally outward from the upper end of base arm 17, and a lower arm 20 extending generally laterally outward from the lower end of base arm 17. Lower arm 20 is shown as being generally longer than upper arm 19 so that, as shown in FIG. 1, when bracket 10 is carried by fixture 11, it will be tilted downwardly, from its back, adjacent to fixture 11, to its front, the farther point away from fixture 11, so as to tilt, in an aesthetically pleasing manner, the merchandise 12 being carried by bracket 10. It should also be noted that arms 19 and 20 effectively space the majority of bracket 10 away from fixture 11 to create the suspended-animation effect for the merchandise 12.

The outer ends of arms 19 and 20 are interconnected by a support arm 21 which is preferably positioned to be in the same vertical plane as base arm 17. An adjustment plate 22 is carried generally centrally of arm 21 and includes a plurality of arcuately spaced apertures 23 therethrough. As will hereinafter be described, apertures 23 cooperate with other elements of bracket 10 so that the merchandise 12 may be positioned at selected angles relative to fixture 11.

Figure 4:
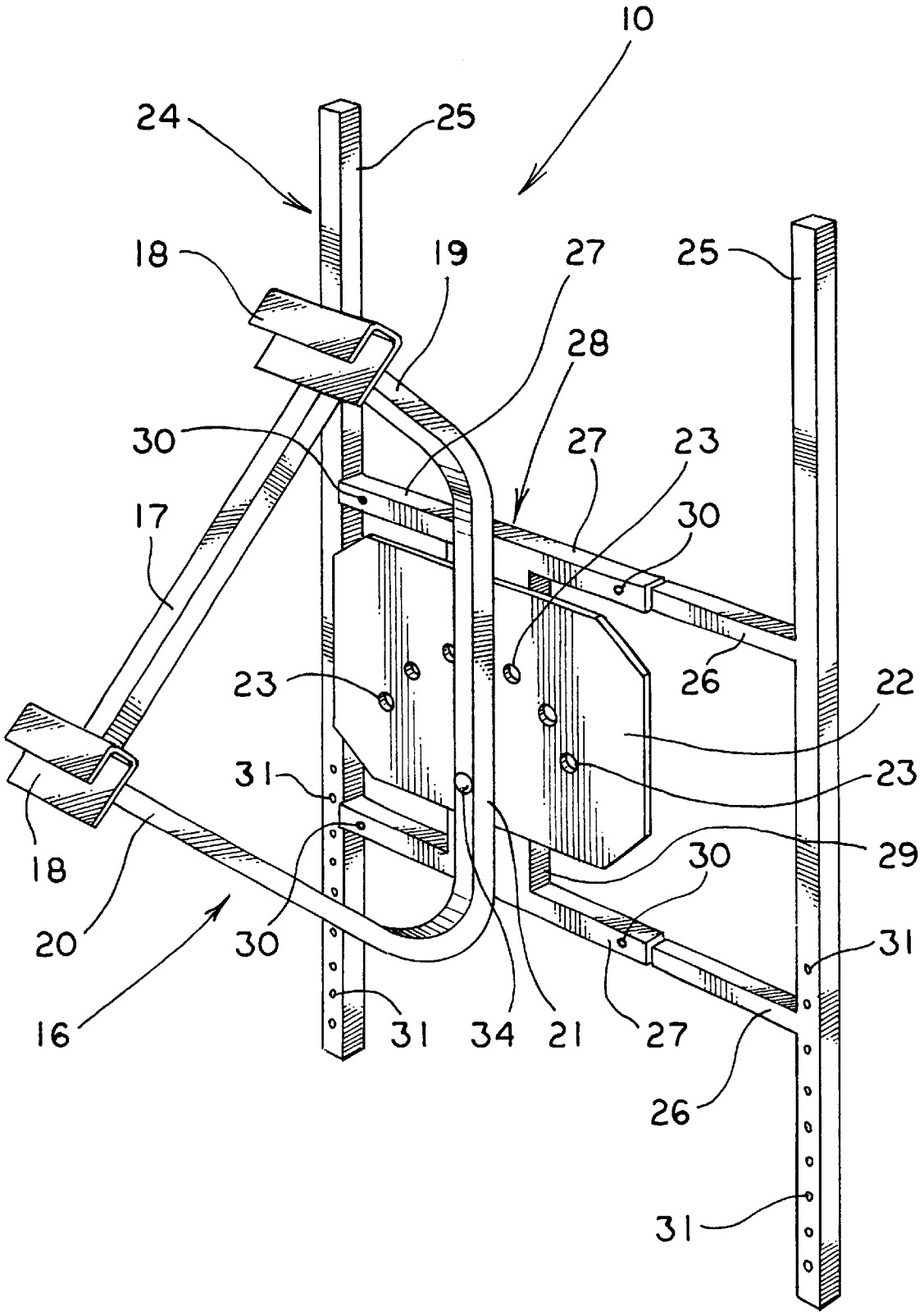
FIG. 4 is a perspective view of the bracket of FIG. 2 showing the manner in which the lateral size of the bracket may be adjusted to accommodate merchandise of various sizes.

Each bracket 10 also includes a generally flat merchandise support frame generally indicated by the numeral 24. As best shown in FIG. 4, support frame 24 includes longitudinally extending, laterally spaced side members 25 each of which have spaced stub posts 26 extending toward each other, a post 26 being shown in FIG. 4 for only one of the side members 25. Posts 26 are adapted to be telescopically received in opposed hollow arms 27 which form a portion of an I-shaped member generally indicated by the numeral 28. A bar 29, which as shown may be in the form of a channel, interconnects arms 27 and thereby completes the I-shape of member 28.

As a result of this configuration, the lateral size of support frame 24 may be adjusted. To that end, arms 27 can be provided with set screws 30 or the like near the ends thereof, and side members 25 can be spaced from each other the desired distance by sliding stub posts 26 into hollow arms 27, and then locking them in place via the tightening of set screws 30. As a result, side members 25 can be positioned relative to each other over a wide range of distances varying from their closest position shown in FIGS. 2 and 3 to a position of almost twice that size if, for example, stub posts 26 were received in arms 27 just far enough so that they could be engaged by set screws 30. Since frame 24 serves as the support for the merchandise 12, brackets 10 can thus accommodate merchandise of a wide variety of lateral sizes.

Figure 3:
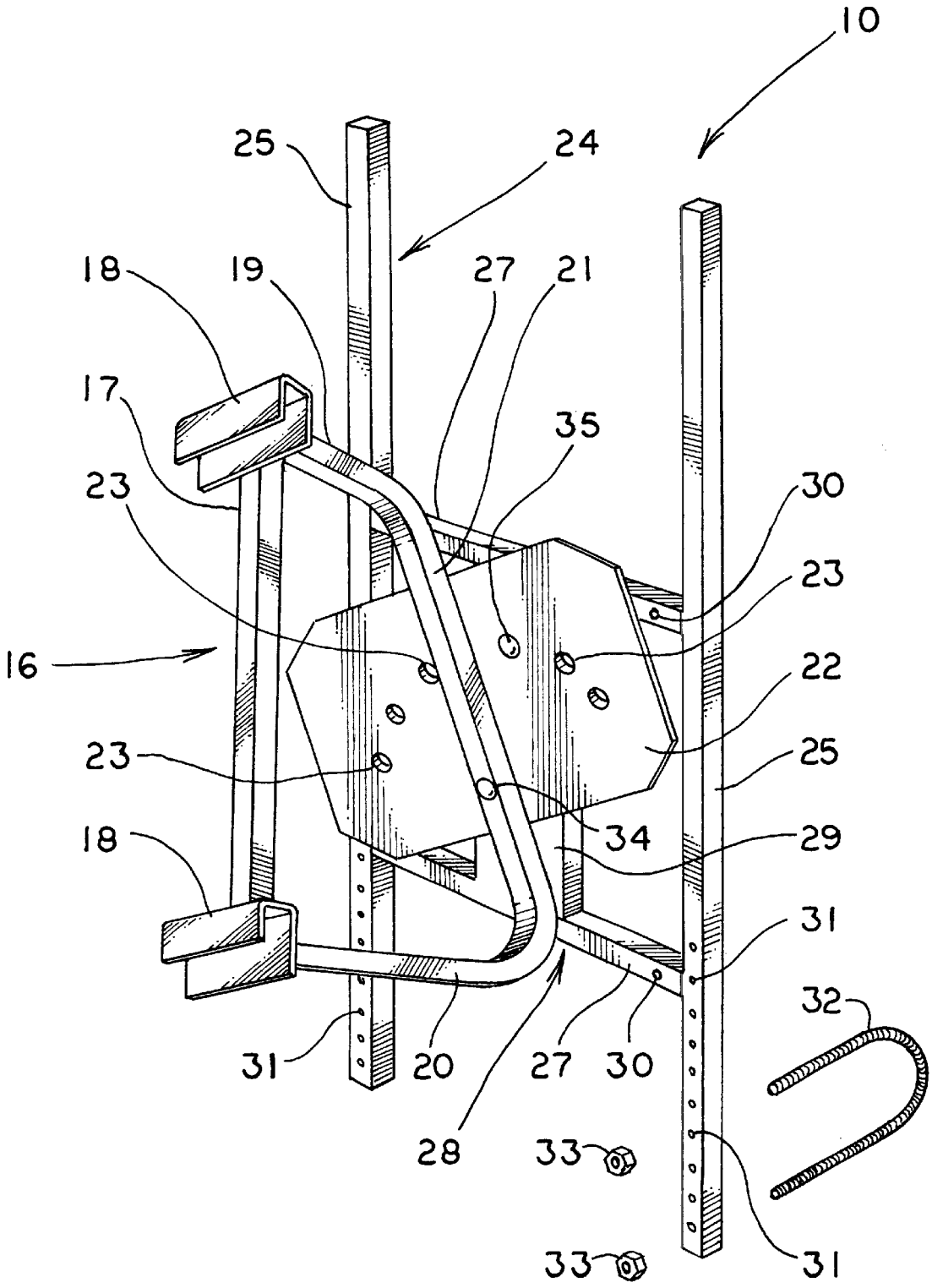
FIG. 3 is a perspective view of the bracket of FIG. 2 showing the manner in which the angle of the merchandise being carried by the bracket, relative to the fixture, can be varied.

Brackets 10 can also accommodate merchandise of various longitudinal sizes. To that end, the outer end of each side member 25, that is, the end of side members 25 positioned farthest away from fixture 11 when bracket 10 is mounted thereon, is provided with a plurality of apertures 31 extending therethrough. Apertures 31 will thus be located adjacent to the front of merchandise 12 which, as shown in FIGS. 1 and 3, is held on support frame 24 by conventional, threaded, and preferably bendable, U-bolts 32. U-bolts 32 can extend around some portion of merchandise 12, such as the axle of the toy car as shown in FIG. 1, and the ends thereof are positioned through selected apertures 31 to receive nuts 33 to hold them in place. Thus, the length of the item of merchandise 12 will dictate which apertures 31 are utilized to hold the merchandise on side members 25.

Figure 2:
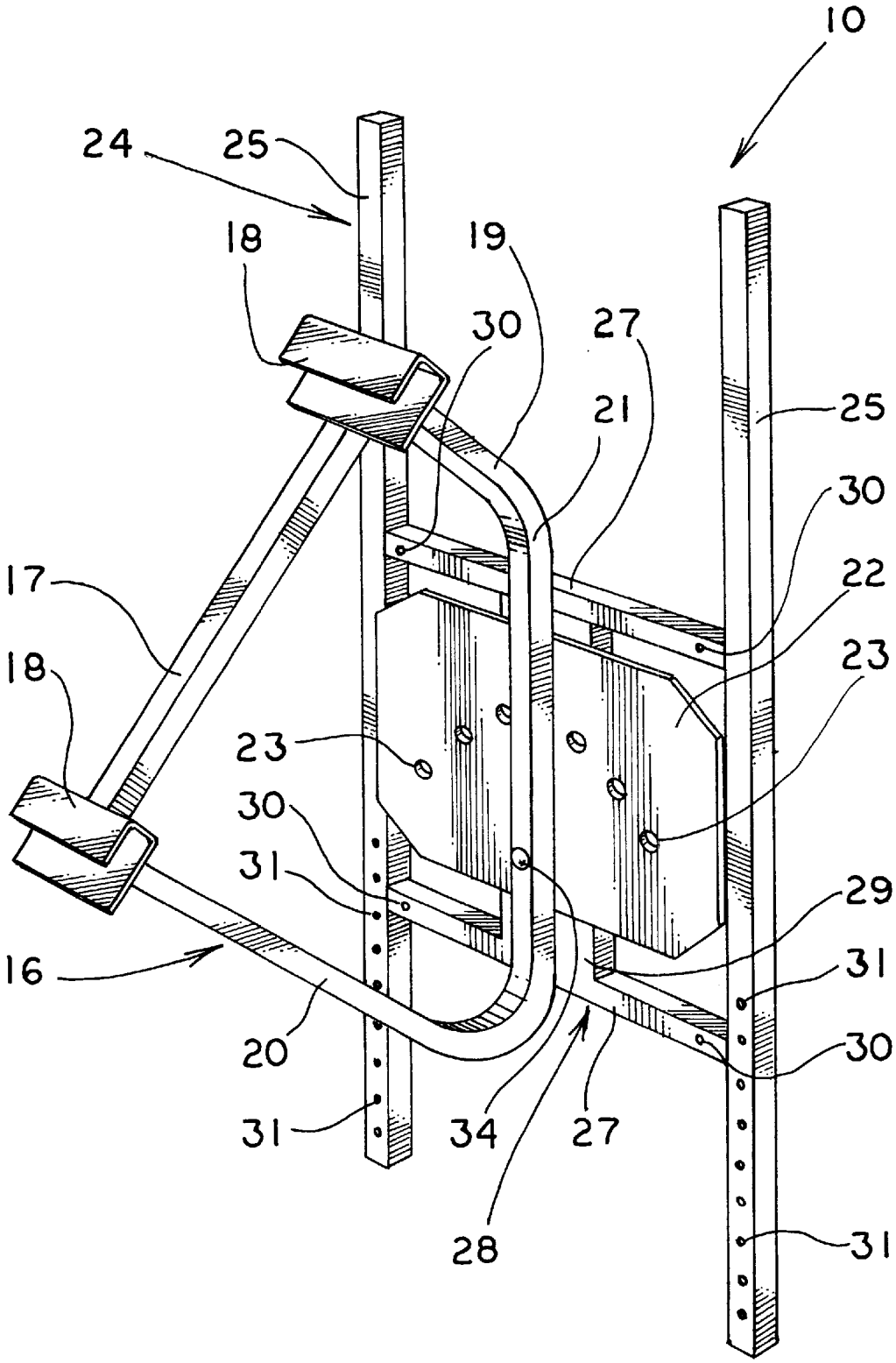
FIG. 2 is a perspective view of a bracket made in accordance with the present invention.

As previously described, brackets 10 may also be positioned at selected angles relative to fixture 11 which gives the retailer the option of displaying merchandise 12 at selected angles relative to fixture 11. For example, as shown in the center of FIG. 1, that bracket 10 is directed out from fixture 11 at an angle of approximately ninety degrees. In this position, the bracket 10 would be positioned as shown in FIG. 2. Or, as shown at the left and right in FIG. 1, brackets 10 may be angled in one direction, or in the opposite direction. Preferably, the retailer may be given the option of several angles for brackets 10, each direction ranging from ninety degrees, that is, lateral to the wall, or effectively zero degrees, that is, parallel to the wall.

To that end, support frame 24 is pivotable relative to mounting member 16 about a pivot pin 34 which extends through bar 29, plate 22, and support arm 21. A protuberance 35 (FIG. 3) formed on bar 29 is received in a selected one of the apertures 23 of plate 22. Thus, to change the angle of frame 24 relative to mounting member 16 when mounting member 16 is attached to fixture 11, one need only grasp side members 25 and rotate frame 24 with sufficient force to move protuberance 35 out of its current aperture 23 and into the desired aperture 23.

In view of the foregoing, it should be evident that a bracket 10 constructed according to the present invention, as described herein, substantially improves the art and otherwise accomplishes the objects of the present invention.

What is claimed is:

1. A bracket adapted to carry merchandise on a fixture comprising a mounting member adapted to be attached to the fixture, an adjusting plate carried at an angle of inclination by said mounting member, and a support frame adapted to carry the merchandise, said support frame being rotatably attached to said adjusting plate at said angle of inclination so that said support frame is rotatable relative to said mounting member without varying said angle of inclination of said support frame so that the merchandise may be carried at a selected rotational angle relative to the fixture.

2. The bracket according to claim 1 further comprising means to maintain said selected rotational angle.

3. The bracket according to claim 2 wherein said means to maintain includes apertures in said adjusting plate and a protuberance carried by said support frame and selectively receivable in one of said apertures.

4. The bracket according to claim 3 wherein said apertures are arcuately spaced.

5. The bracket according to claim 1 wherein said support frame includes laterally spaced side members.

6. The bracket according to claim 5 further comprising means to attach the merchandise to said side members.

7. The bracket according to claim 5 further comprising means to adjust the lateral space between said side members.

8. The bracket according to claim 1 wherein said mounting member includes a base arm and a channel plate formed near each end of said base a arm, said channel plates being adapted to engage the fixture.

9. The bracket according to claim 8 wherein said mounting member includes an upper arm extending from one end of said base arm and a lower arm extending from the other end of said base arm, said upper and lower arms adapted to position the merchandise spaced from the fixture.

10. The bracket according to claim 9 wherein said lower arm is longer than said upper arm so as to tilt the merchandise at said angle of inclination.

11. A bracket adapted to carry merchandise on a fixture comprising a mounting member adapted to be attached to the fixture, a support frame adapted to carry the merchandise, said support frame including laterally spaced side members and being pivotally attached to said mounting member so that the merchandise may be carried at a selected angle relative to the fixture, and means to attach the merchandise to said side members, said means to attach including a bolt received in selected apertures in said side members.

12. A bracket adapted to carry merchandise on a fixture comprising a mounting member adapted to be attached to the fixture, a support frame adapted to carry the merchandise, said support frame including laterally spaced side members and being pivotally attached to said mounting member so that the merchandise may be carried at a selected angle relative to the fixture, and means to adjust the lateral space between said side members, said means to adjust including posts carried by said side members, said support frame having a hollow arm to receive said posts, and means to attach said posts to said hollow arm.

13. A bracket adapted to carry merchandise on a fixture comprising a mounting member adapted to be attached to the fixture, and a support frame carried by said mounting member and adapted to carry the merchandise, said support frame including laterally spaced side members, posts carried by said side members and a hollow arm to receive said posts, the lateral space between said side members being adjusted dependent on the extent to which said posts are received in said hollow arm so that said support frame can carry merchandise of varying sizes.

14. The bracket according to claim 13 further comprising means to attach said posts to said hollow arm.

15. The bracket according to claim 13 further comprising means to attach the merchandise to said side members.

16. The bracket according to claim 13 further comprising means to pivotally attach said support frame to said mounting member so that the merchandise may be carried at a selected angle relative to the fixture.

17. The bracket according to claim 16 further comprising means to maintain said selected angle.

18. The bracket according to claim 17 wherein said means to maintain include an adjusting plate carried by said mounting member and having apertures therein, and a protuberance carried by said support frame and selectively receivable in one of said apertures.

19. The bracket according to claim 13 wherein said mounting member includes a base arm and a channel plate formed near each end of said base arm, said channel plates being adapted to engage the fixture.

20. The bracket adapted to carry merchandise on a fixture comprising a mounting member adapted to be attached to the fixture, a support frame carried by said mounting member and adapted to carry the merchandise, said support frame including laterally spaced side members and being adjustable so as to be adapted to carry merchandise of varying sizes, and means to attach merchandise to said side members, said means to attach including a bolt received in selected apertures in said side members.

21. A bracket adapted to carry merchandise on a fixture comprising a mounting member adapted to be attached to the fixture, and a support frame carried by said mounting member and adapted to carry the merchandise, said support frame being adjustable so as to be adapted to carry merchandise of varying sizes, said mounting member including a base arm, an upper arm extending from one end of said base arm and a lower arm extending from the other end of said base arm, said upper and lower arms adapted to position the merchandise spaced from the fixture.

22. The bracket according to claim 21 wherein said lower arm is longer than said upper arm so as to tilt the merchandise from horizontal.

23. A bracket adapted to carry merchandise on a fixture comprising mounting means adapted to be attached to the fixture, support means adapted to carry the merchandise and including longitudinally extending, laterally spaced side members, means to pivot said support means relative to said mounting means so that the merchandise may be carried at a selected angle relative to the fixture, and means to adjust said support means so that said support means may carry merchandise of varying sizes, said means to adjust including apertures in said side members and a bolt received in selected of said apertures to hold the merchandise at a selected longitudinal position on said side members.

24. The bracket according to claim 23 further comprising means to maintain said selected angle.

25. The bracket according to claim 24 wherein said means to maintain include an adjusting plate carried by said mounting means and having apertures therein, and a protuberance carried by said support means and selectively receivable in one of said apertures.

26. The bracket according to claim 25 wherein said means to pivot includes a pin connecting said adjusting plate to said support means, said apertures being spaced on an arc relative to said pin.

27. A bracket adapted to carry merchandise on a fixture comprising mounting means adapted to be attached to the fixture, support means adapted to carry the merchandise and including longitudinally extending, laterally spaced side members, means to pivot said support means relative to said mounting means so that the merchandise may be carried at a selected angle relative to the fixture, and means to adjust said support means so that said support means may carry merchandise of varying sizes, said means to adjust including posts carried by said side members, said support means including a hollow arm to receive said posts, and means to attach said posts to said hollow arm at a preselected position to adjust the lateral space between said side members.

* * * * *